US005882053A

United States Patent [19]

Bekins et al.

[11] Patent Number: 5,882,053

[45] Date of Patent: Mar. 16, 1999

[54] VEHICLE DOOR/TAILGATE ASSEMBLY WITH CENTERING FEATURE

[75] Inventors: Terrence J. Bekins, West Olive; Jeffrey J. Veltkamp, Holland; Vernon R. Nise, Caledonia, all of Mich.

[73] Assignee: Donnelly Corporation, Holland, Mich.

[21] Appl. No.: 663,802

[22] Filed: Jun. 14, 1996

[51] Int. Cl.[6] ..... E05B 3/08

[52] U.S. Cl. ..... 292/336.3; 292/356

[58] Field of Search ..... 292/336.3, 356, 292/DIG. 29, 348, 355; 74/504, 511 R, 527

[56] References Cited

U.S. PATENT DOCUMENTS

| | | | |
|---|---|---|---|
| 1,910,125 | 5/1933 | Root | 74/556 |
| 2,278,534 | 4/1942 | Dickason | 292/347 |
| 2,427,909 | 9/1947 | Howell | 292/356 X |
| 2,573,028 | 10/1951 | Kramer | 292/336.3 |
| 2,656,208 | 10/1953 | Janonis | 292/216 |
| 2,840,410 | 6/1958 | Jakeway | 292/336.3 |
| 2,961,265 | 11/1960 | Jakeman et al. | 292/216 |
| 4,669,765 | 6/1987 | Ullman | 292/153 |
| 4,805,947 | 2/1989 | Farris | 292/336.3 |
| 4,835,997 | 6/1989 | Akright | 70/141 |
| 5,180,201 | 1/1993 | Hauber | 292/336.3 |
| 5,183,310 | 2/1993 | Shaughnessy | 292/DIG. 29 X |
| 5,450,735 | 9/1995 | Esaki et al. | 74/527 X |
| 5,524,786 | 6/1996 | Skudlarek | 292/162 X |

FOREIGN PATENT DOCUMENTS

| | | | |
|---|---|---|---|
| 43312 | 4/1934 | France | 292/356 |
| 279840 | 5/1928 | United Kingdom | 74/504 |
| 1028366 | 5/1966 | United Kingdom | 292/336.3 |

*Primary Examiner*—Steven Meyers
*Assistant Examiner*—Gary Estremsky
*Attorney, Agent, or Firm*—Van Dyke, Gardner, Linn & Burkhart LLP

[57] ABSTRACT

A vehicle door/tailgate handle assembly for unlatching either a combined door/tailgate and window as a unit or the window unit alone provides an improved centering/alignment feature which avoids reliance on prior known spirally wrapped, low tolerance, low cycle life springs. The handle assembly includes a handle grip, mounting base and a centering member which centers and aligns the handle grip on the mounting base. The handle grip is rotatably mounted in a shaft receiving passage on the mounting base and a centering member is slidably disposed on shaft for movement along and rotation with the shaft for slidable engagement with the rear side of the mounting base. When a rotational torque is applied to the handle grip, the centering member slides along the shaft away from the rear side of the mounting base to permit the handle grip to rotate between a first unlatching position and a second unlatching position. The centering member aligns the handle grip with the mounting base in a third, centered position when the rotational torque is removed from the handle grip. Preferably, the handle grip, mounting base and centering member include cooperating camming surfaces which are urged toward one another by a compression/coil spring having a high cycle life and low failure rate. Stop surfaces are preferably included on the handle grip and mounting base to limit the extend of rotational movement.

63 Claims, 7 Drawing Sheets

"PRIOR ART"

VEHICLE DOOR/TAILGATE ASSEMBLY WITH CENTERING FEATURE

TECHNICAL FIELD AND BACKGROUND OF THE INVENTION

The present invention relates to handle assembly especially suited for vehicle doors and on tailgates on sport utility vehicles, vans, mini-vans, station wagons, and the like, and, more particularly, to a rear tailgate handle with improved centering and alignment with a mounting base.

Handles that are used to unlatch the tailgate of a vehicle are quite often also used to unlatch a window unit housed in the tailgate. Typically, the handle grip of the assembly assumes a neutral position in which both the window unit and the tailgate are latched. The handle must be rotated from its neutral position to one of two positions, with one position unlatching the tailgate and the other position unlatching the window unit in the tailgate. The direction of the handle grip's rotation dictates which of the two is unlocked for opening. For example, a counterclockwise rotation could unlock the tailgate while a clockwise rotation of the handle would then unlock the window unit in the tailgate. The un-rotated center position of the handle grip defines the neutral position of the assembly in which both the tailgate and the tailgate window are latched.

Conventional tailgate handles include spirally wrapped springs to center a handle grip on the handle mounting base in its neutral position. The spirally wrapped spring has distal ends which engage both the handle mounting base and the handle grip, with the spring being coiled around the handle mounting base to bias the handle grip to the center position, wherein the handle grip is aligned with the handle mounting base.

Several problems have developed with the conventional handles, however. As best shown in FIG. 1 of the drawings, over time the spirally wrapped spring can relax or its distal ends can bend and, eventually, no longer fully bias the handle grip to the center position. This results in a handle grip that is no longer aligned with the handle mounting base by an angular amount X (FIG. 1). Moreover, wrapped spring suppliers do not generally guarantee their springs for a tolerance less than ±7 degrees of play. While this particular non-aligned condition does not seriously affect the latching/unlatching function of the handle, the handle does have the appearance of being broken and is not aesthetically pleasing.

Second, the installation of a spirally wrapped spring is labor intensive and difficult. Conventionally, during installation, a first end of the spring is inserted through a slotted opening provided in a collar of the mounting base and into a receiving structure provided in the shaft, with the first end of the spring abutting a first side of the slotted opening to fix the end of the spring in a unilateral direction. The spring is coiled around the collar of the mounting base, and, then, the second end of the spring is inserted through the same opening in the mounting base, abutting a second side of the opening, and into the same receiving structure on the shaft. During such installation, the spring is easily bent; therefore, the quality of the installation and handle performance can be jeopardized. In addition, the spring is hard to grasp during such coiling and requires a significant level of manual dexterity to complete the assembly. During operation, when the handle grip is rotated, the shaft, which is fixed to the handle grip, rotates, pulling the first end of the spring while the second end of the spring is seated against the second side of the slotted opening. This causes the spring to twist and compress until the first end of the spring is rotated from the first side to the second side of the slotted opening, so that both ends of the spring abut the same side of the slotted opening. At this point the spring cannot undergo further twisting or compression, and the handle grip is fully turned in one direction. When the handle is released, the spring will expand and induce rotation in the shaft until the first end of the spring is again abutting the first side of the slotted opening. Similarly, when the handle is rotated in the opposite direction, the same operation occurs except that the second end of the spring will travel from the second side of the slotted opening to the first side of the slotted opening. When operated in this way, the wrapped spring tends to lose tension over time. Coupled with the imprecise tolerance levels in the manufacture of such springs, the loss in tension prevents full return of the shaft and handle grip, resulting in the above non-centered position.

Lastly, a spirally wrapped spring has a relatively low cycle life. The wrapped spring is typically mounted to the mounting base and the shaft of the handle grip at its free ends, but the free ends are bent inward to grip the sides of the slotted opening in the mounting base and the receiving structure in the shaft. The bends at the free ends increase stress concentration factors on the spring and, ultimately, may lead to breakage. When combined with the necessary cycles associated with a tailgate handle over the life span of a vehicle and environmental factors, such as exposure to extreme temperatures and corrosive substances, the overall cycle life of the spring is significantly reduced and, often, reduced to unacceptable levels for automobile manufacturers.

Consequently, there is a need for a door/tailgate handle that can maintain the alignment of the handle grip with its mounting base, perform all required latching/unlatching functions, and yet have a significantly longer cycle life.

SUMMARY OF THE INVENTION

Accordingly, the present invention provides a new and unique handle assembly, especially for vehicle doors, lift gates and/or tailgates on sport utility vehicles, vans, mini-vans, station wagons, and the like, which includes an improved centering feature to align the handle with its mounting plate except when the handle is in use. The handle grip is positively aligned with its mounting base through a centering member including camming surfaces which are continuously urged against one another to maintain the handle grip in alignment without looseness or play and without reliance on low tolerance, low cycle life spirally wrapped springs.

According to one aspect of the invention, a vehicle handle assembly includes a handle grip having front and rear surfaces and a shaft on the rear surface adapted to extend through a mounting base for the handle grip. The mounting base is adapted to mount the handle grip on a vehicle panel and includes front and rear sides and a shaft receiving passage extending therethrough. The shaft of the handle grip extends through and is journaled in the shaft receiving passage for rotational movement therein. A centering member is slidably disposed on the shaft for longitudinal movement along the shaft and rotation with the shaft. The centering member is positioned on that portion of the shaft which extends through the shaft receiving passage in the mounting base and slidably engages the rear side of the mounting base. When a rotational torque is applied to the handle grip, the centering member slides along this shaft away from the rear side of the mounting base to permit the handle grip to rotate between a first unlatching position and a second unlatching position. The centering member aligns the handle grip with the mounting base in a third, centered position when the rotational torque is removed from the handle grip.

In preferred aspects of the invention, a spring is telescoped over the shaft and held in engagement with the centering member by a retaining clip. Preferably, the spring is a coil spring having a compression force selected such that when a rotational force that induces a compression force greater than the selected compression force of the spring is applied to the handle grip, the centering member will move along the shaft in the intended manner and compress the spring.

In other aspects, the handle assembly preferably includes cooperating camming surfaces on the centering member and the rear of the mounting base. Preferably, such camming surfaces include at least one notch in the mounting base and a corresponding camming projection formed in the shape of a triangularly shaped tooth engaging the notch. The camming surfaces on the tooth extend at an angle to the shaft axis for proper camming operation. In addition, a second camming surface may be included between the handle grip and the centering member to eliminate any play or looseness of the handle grip when in the centered position. Such additional camming surface preferably includes a notch in the handle grip and a projecting tooth having angled camming surfaces on the centering member at a position spaced from the first camming surface. Preferably, the centering member is a cup-shaped, annular body having a base and a cylindrical wall with a shaft opening extending through the base and at least one of the above mentioned camming surfaces formed on the cylindrical wall for slidably engaging the corresponding camming surface on either the mounting base or handle grip.

In addition, the handle assembly preferably includes a stop on the handle grip which engages shoulders or stop surfaces on the mounting base to limit rotation of the handle grip whereby the camming surfaces remain engaged at all times so that the handle grip is returned to its centered position when the rotational force is removed.

As will be understood, the vehicle door/tailgate handle assembly of the present invention provides numerous advantages over prior known handle assemblies used on vehicle tailgates or doors. The handle assembly overcomes the lack of alignment between the handle and mounting base which is evident with prior known handle assemblies using spirally wrapped springs or other methods. The handle grip on the present invention is continuously centered and aligned with the mounting base by the combination of a cammed centering member and a compression/coil spring which constantly urges the centering device to return the handle grip to its parallel, centered position. The compression/coil spring is far less susceptible to relaxation than a spirally wrapped spring. The handle grip maintains its aligned position with the mounting base throughout the life of the vehicle. Moreover, even when the compression/coil spring in the present invention experiences limited relaxation, such relaxation merely causes reduced handle effort but does not effect maintenance of the centering/alignment feature. Further, such alignment is maintained with little or no looseness or play between the handle grip and the mounting base when in the centered position, unlike prior known assemblies. The compression/coil spring is less susceptible to fatigue or failure because its method of application relies on compression instead of twist-type tensioning. In addition, the force is applied in a relatively uniform manner over the entire spring such that the coils of the spring are compressed rather than twisted. There are no bent ends to increase local stress in the spring. Consequently, the cycle life of the preferred compression/coil spring is increased some five to one hundred times over the spirally wrapped spring. Thus, repair and replacement costs are significantly reduced. Further, manufacture of the present vehicle handle assembly is easier than with prior known handles incorporating spirally wrapped springs since the parts of the present invention are easily telescoped and slide over one another with only a single retaining clip being installed to finish the assembly. The previous requirements of manual dexterity and stretching of a twisted, spiral spring are completely unnecessary, thereby reducing assembly time and increasing reliability of the resultant product.

These and other objects, advantages, purposes and features of the invention will become more apparent from a study of the following description taken in conjunction with the drawings.

DESCRIPTION OF THE PREFERRED EMBODIMENTS

Figure 1:
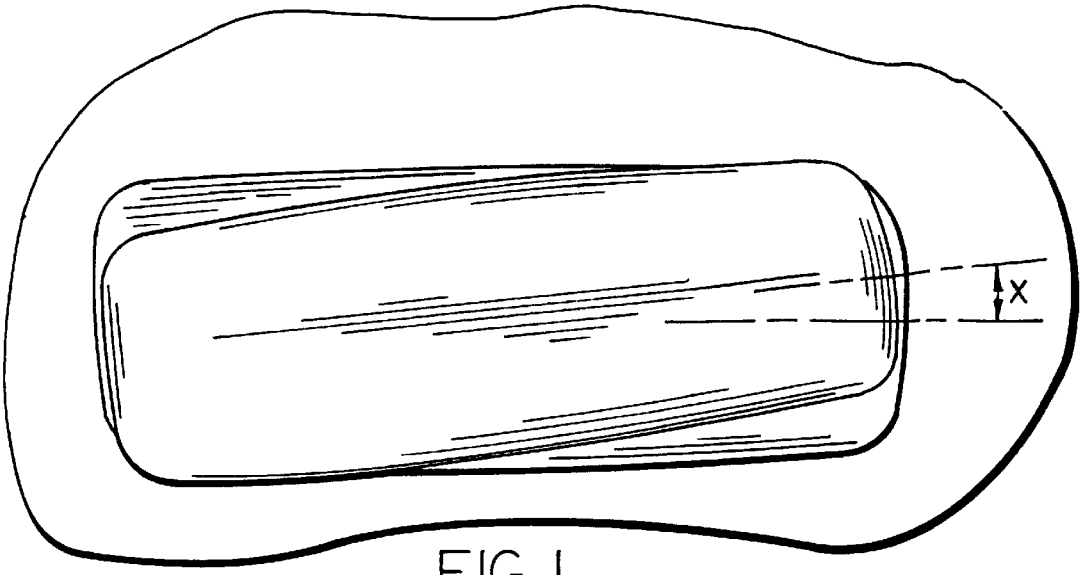
FIG. 1 is a front elevation of a prior art rear tailgate handle mounted on a vehicle panel illustrating the non-parallelism between the handle grip and the mounting base.
Figure 2:
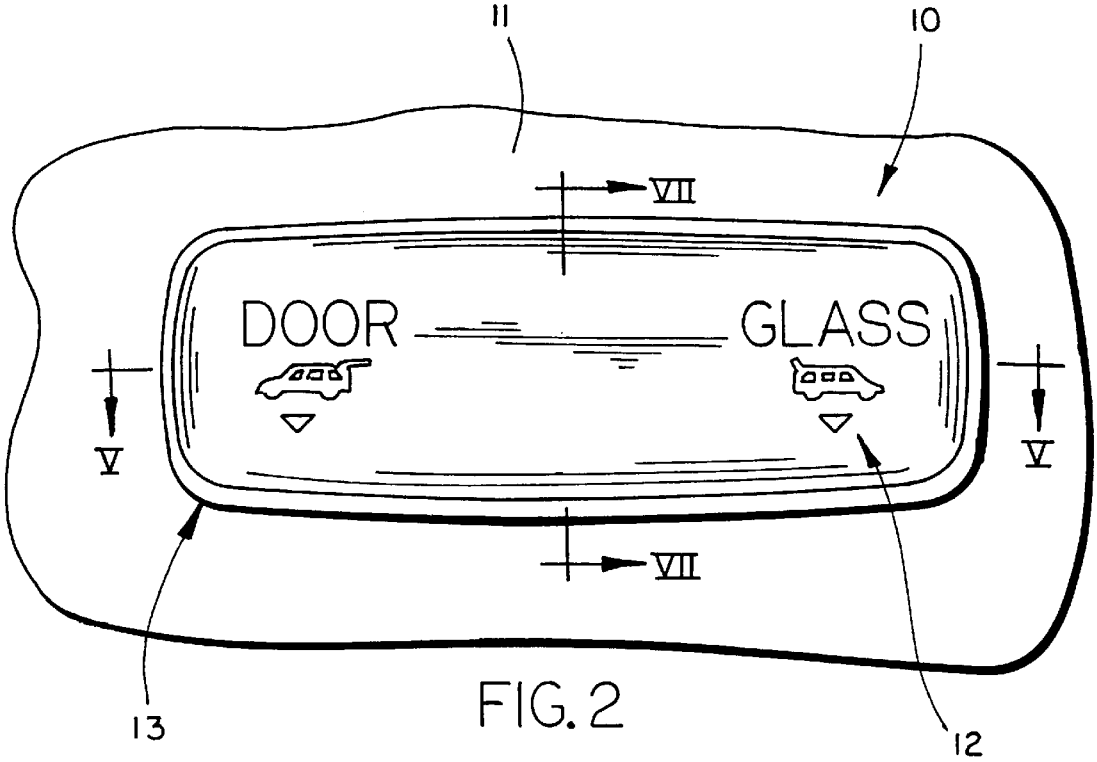
FIG. 2 is a front elevation of the vehicle handle assembly of the present invention mounted to a vehicle panel such as a rear tailgate.
Figure 3:
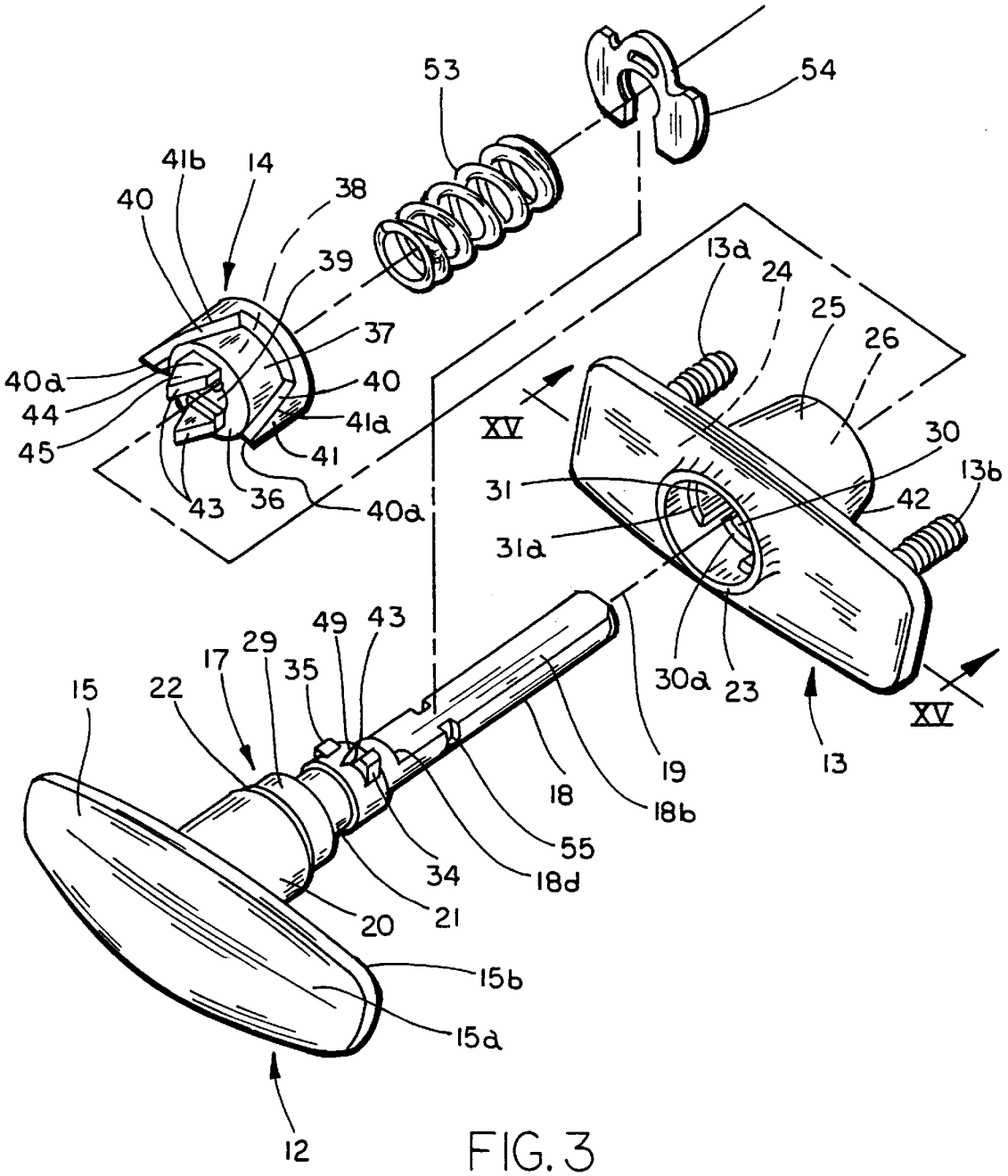
FIG. 3 is an exploded perspective view of the vehicle handle assembly of FIG. 2.

Referring to FIGS. 2 and 3, a vehicle handle assembly 10 of the present invention is shown mounted to a rear tailgate panel 11 of a vehicle. Handle assembly 10 is mounted to the panel 11 by a mounting base 13 preferably by a pair of threaded studs 13*a*, 13*b* which pass through the body sheet metal and are secured with nuts or other fasteners on the opposite side of the sheet metal. A handle grip 12 is journaled in mounting base 13 for rotation between a door unlatching position (counter clockwise in FIG. 2), a window unlatching position (clockwise in FIG. 2), and a centered or neutral position wherein grip 12 is generally parallel to base 13. Handle grip 12 is centered on the mounting base 13 by a centering member 14, as explained below. Tailgate panel 11 typically is of the type including a hinged door or panel which may be unlatched to swing open via handle assembly 10. In addition, panel 11 usually also includes a hinged window which may be unlatched and opened also using assembly 10. As explained more fully below, operation of the handle grip 12 in opposite directions opens either the door or panel and window together or just the window as desired.

Handle grip 12 comprises a T-shaped body 15 having front and rear surfaces 15*a* and 15*b* and a neck 17 depending from rear surface 15*b*. Extending from the rear surface 15*b* of the T-shaped body 15 and through neck 17 is a shaft 18 whose longitudinal axis 19 is coextensive with the central axis of neck 17. Neck 17 includes a cylindrical base portion 20 which extends from lower surface 15*b* to a reduced diameter positioning collar 21, with a resilient, o-ring seal 22 positioned therebetween in a groove to provide a water resistant seal between the handle grip 12 and the mounting base 13. Preferably, the T-shaped body 15 and the neck 17 are integrally formed by injection molding from a plastic material. More preferably, the T-shaped body is formed from a resinous material, such as ABS plastic, and, most preferably, formed from CAPRON ® 8267 material available from Allied Signal of Morristown, N.J. Shaft 18 is preferably metal and, more preferably, steel and is typically insert molded within neck 17 and body 15 of grip 12. Most preferably, shaft 18 is steel with zinc plating for salt corrosion protection.

Figure 13:
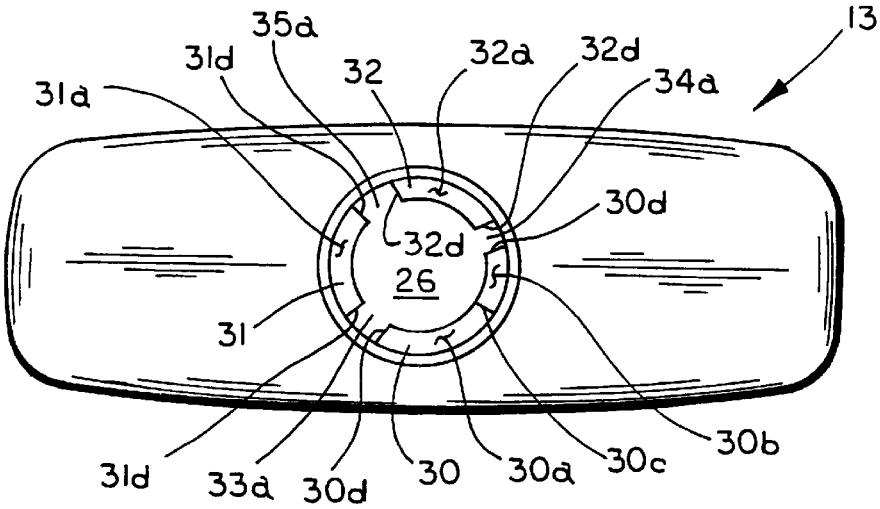
FIG. 13 is a front elevation of the handle mounting base.
Figure 14:
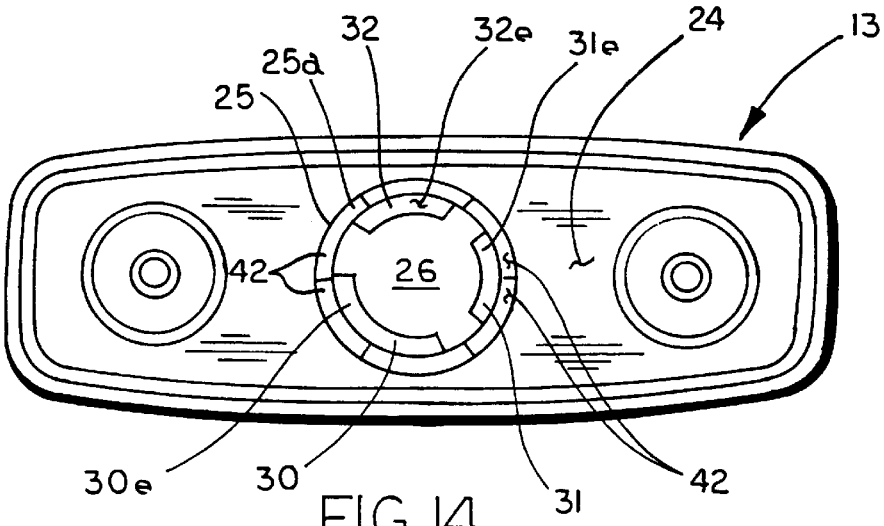
FIG. 14 is a rear elevation of the mounting base.
Figure 15:
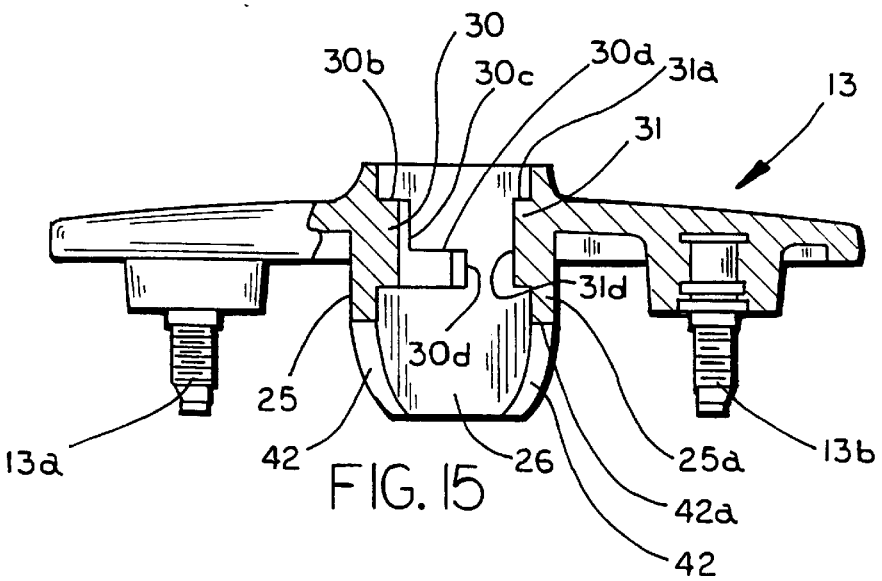
FIG. 15 is a sectional plan view of the mounting base taken along line XV—XV of FIG. 3.
Figure 16:
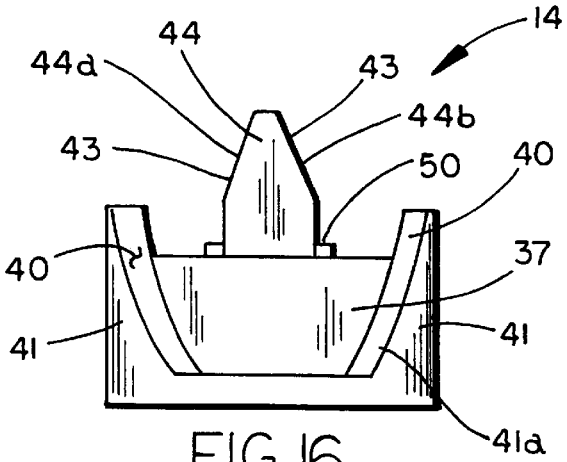
FIG. 16 is a first side elevational view of the centering member.
Figure 17:
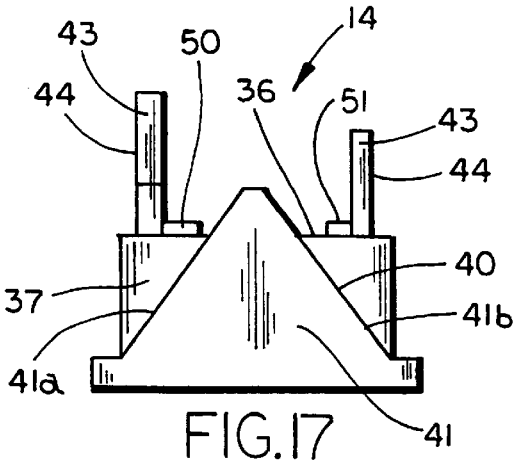
FIG. 17 is a second side elevational view of the centering member taken at 90° to that of FIG. 16.
Figure 18:
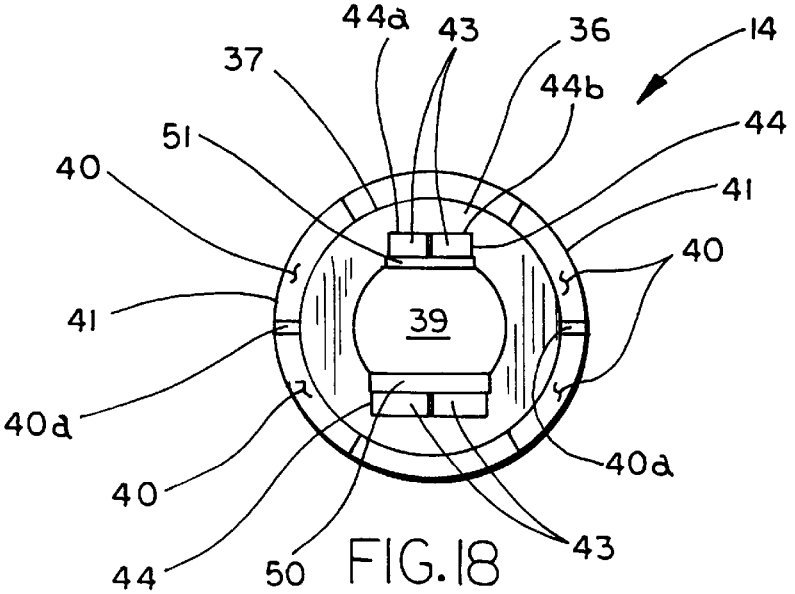
FIG. 18 is a top plan view of the centering member.

Handle grip 12 extends into and is journaled in mounting base 13 through a shaft opening 23 that extends through the mounting base 13. Preferably, mounting base 13 is formed by injection molding from a plastic material. More preferably, the mounting base 13 is formed from a resinous material, such as ABS plastic, and, most preferably formed from CAPRON ® 8267. As shown in FIGS. 3–7, mounting base 13 has a member, centering collar 25, projecting from its rear surface 24. Centering collar 25 cooperates with centering member 14 to align the handle grip 12 with mounting base 13 and is aligned with shaft opening 23 to define a continuous shaft passage 26 through which shaft 18 extends. Handle grip 12 is supported in passage 26 by a stop 28 and a shoulder 29 that are formed on positioning collar 21. Stop 28 and shoulder 29 rest on first, second, and third circumferentially spaced abutments 30, 31, and 32 which project radially into passage 26. As can be seen in FIGS. 13–15, first abutment 30 includes two offset planar surfaces 30*a* and 30*b*, with surface 30*a* positioned below surface 30*b* to provide support for stop 28. Surface 30*b* provides support for shoulder 29. Similarly planar surfaces 31*a* and 32*a* of abutments 31 and 32, which are coplanar with surface 30*b*, provide support at spaced circumferentially spaced locations for shoulder 29 and are circumferentially spaced from abutment 30 to support handle 12 at approximately three equally spaced points.

Stop 28 provides several functions. As described above, stop 28 provides a support surface for handle grip 12 in passage 26. Moreover, stop 28 provides a limit stop for the handle grip to limit the rotation of the handle grip 12 between a first rotational position wherein the tailgate is unlatched and a second position wherein the window unit in the tailgate is unlatched. As planar surface 30*a* is lower than planar surface 30*b* and the other planar surfaces 31*a* and 32*a* of the abutments 31 and 32, stop 28 is positioned between the vertical faces 30*c* and 31*d* of abutments 30 and 31 and, therefore, limits the rotation of the handle grip between vertical faces 30*c* and 31*d* of the adjacent abutments 30 and 31. The spacing between the vertical faces 30*c* and 31*d* together with the width of stop 28 control the range of rotational motion of handle grip 12. This range of motion is preferably between 0° and 120° and, more preferably, between 0° and 80° . Most preferably, the angle of rotation of the handle grip 12 between the window unlatching position and the tailgate unlatching position is approximately 76°. As will be more fully understood in reference to the discussion of the centering member, the limited rotational movement of handle grip 12 with respect to the mounting base 13 assures that the centering member properly cooperates with the mounting base 13 to center the handle grip to one preferred orientation—the orientation illustrated in FIG. 2.

An important aspect of assembling any handle is to provide an assembly that can be quickly and easily assembled in the proper order and with the sub-components installed in the proper orientation. To achieve this in the present invention, handle grip 12 includes positioning lugs 33, 34, and 35 (FIGS. 3 and 8–11). Positioning lugs 33, 34, and 35 extend outwardly from positioning collar 21 to provide a guide for inserting handle grip 12 into mounting base 13. Lugs 33, 34, and 35 are circumferentially spaced around collar 21 and are positioned to align with the passages 33*a*, 34*a*, and 35*a* formed between the vertical faces 30*d* and 31*d*, 31*d* and 32*d*, and 32*d* and 30*d* of circumferentially spaced abutments 30, 31, and 32 (FIG. 13). Once the lugs 33, 34, and 35 are aligned with passages 33*a*, 34*a*, and 35*a*, respectively, handle grip 12 may be inserted and rotated to releasably lock the handle grip into mounting base 13. More specifically, after handle grip 12 is fully inserted into mounting base 13, handle grip 12 is rotated so that stop 28 slides on to surface 30*a* of abutment 30 and lugs 33, 34, and 35, extending past vertical surfaces 30*d*, 31*d*, and 30*d* of the abutments, and slide over locking surfaces 30*e*, 31*e*, and 32*e* on the rear side of abutments 30, 31, and 32, respectively, to lock handle grip 12 against movement along the axis of passage 26 in mounting base 13. In one aspect, these locking lugs are load transferring devices. In another aspect, the locking lugs prevent the handle grip from disengaging with the mounting base while the other components of the handle are being installed.

Figure 7:
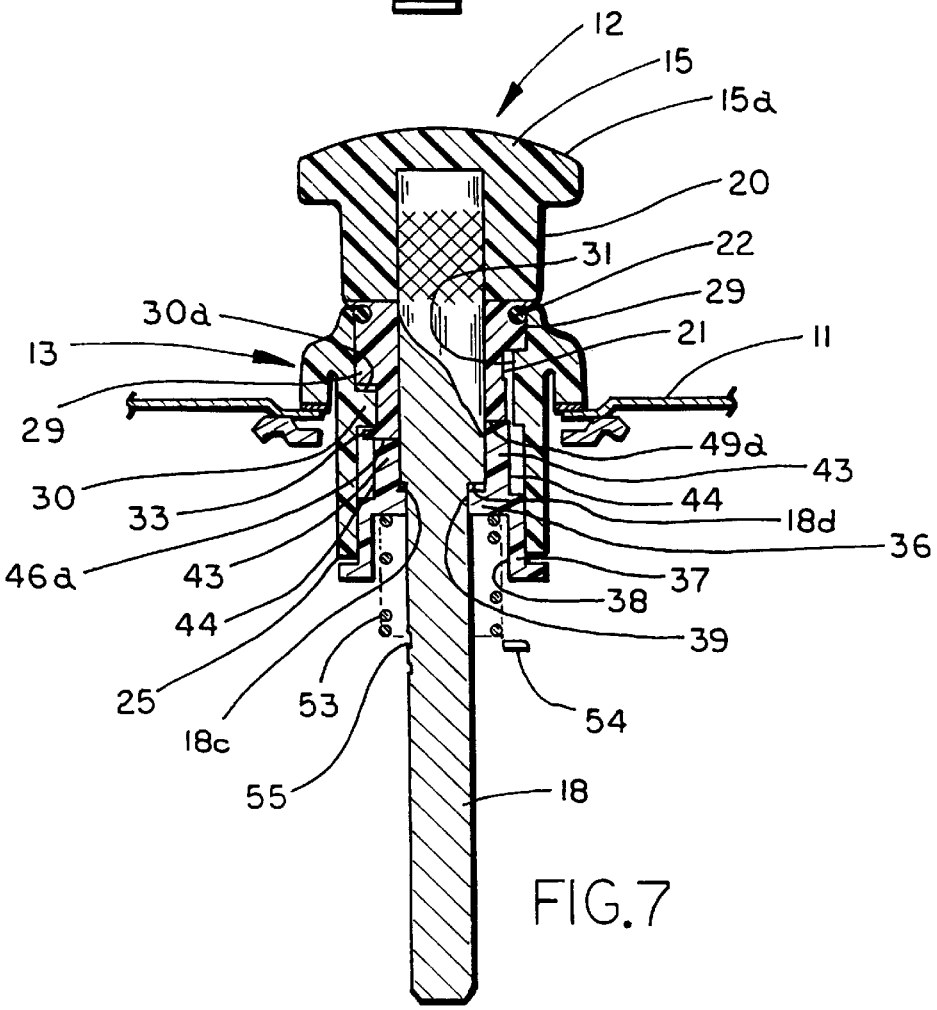
FIG. 7 is a sectional side elevation of the vehicle handle assembly taken along line VII—VII of FIG. 2, illustrating the centering member fully biased against the handle grip.

To further aid in the assembly of the handle and to enable centering member 14 to impart rotation to the shaft, shaft 18 includes first and second planar surfaces 18*a* and 18*b*. Planar surfaces 18*a* and 18*b* extend substantially over the full exposed length of the shaft, with first planar surface 18*a* formed at a first distance from longitudinal axis 19 of shaft 18 and second planar surface 18*b* formed at a second distance from axis 19 of shaft 18. Preferably the first distance is less than the second distance and, as a result, the width of first surface 18*a* is greater than the width of the second surface 18*b* and the size of the shoulders 18*c* and 18*d* formed at the transitions from the fully circular cross-section of the shaft to the planar surfaces are similarly proportioned (FIG. 7). As will be more fully explained, by making planar surfaces 18*a* and 18*b* with different dimensions, centering member 14, which slips on the end of the shaft for longitudinal movement along the shaft, can be installed in only one of two orientations.

Figure 5:
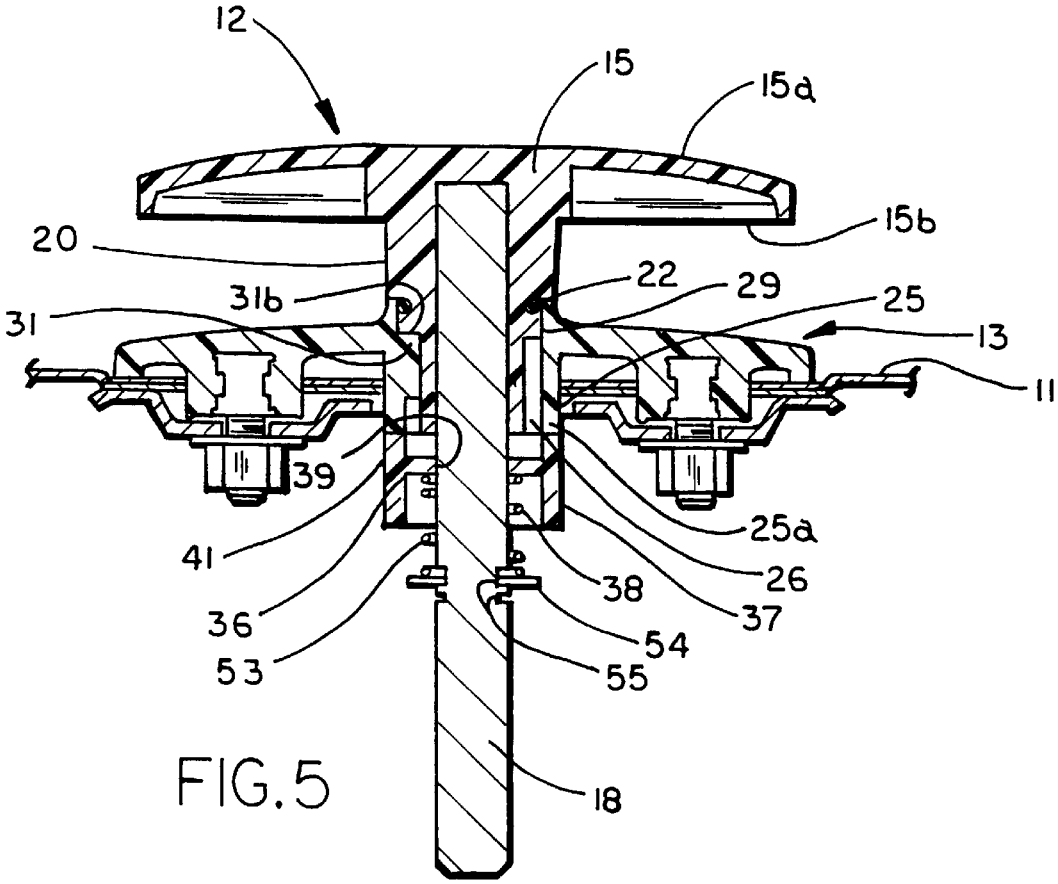
FIG. 5 is a sectional plan view of the handle assembly taken along line V—V of FIG. 2, illustrating the handle grip mounted to the mounting base and the centering member installed on the shaft handle grip and fully biased against the mounting base.
Figure 6:
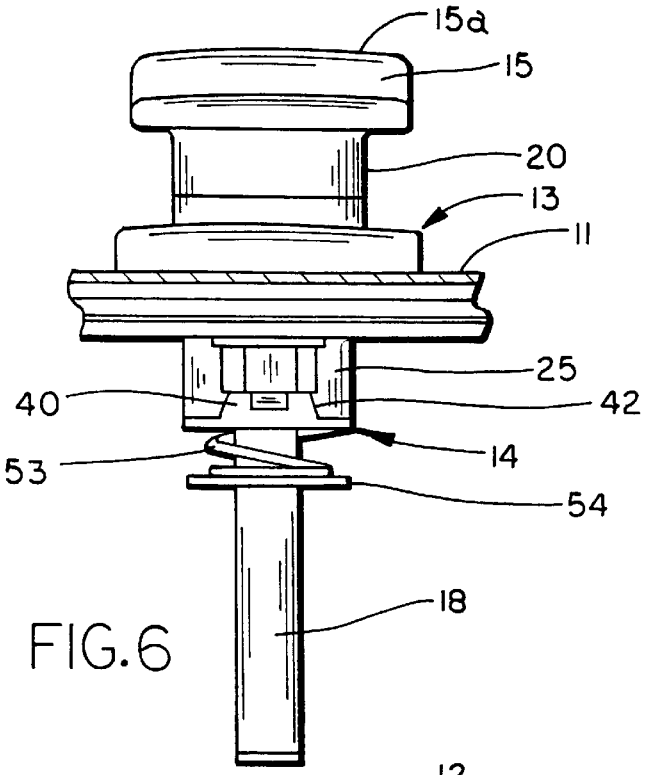
FIG. 6 is a side elevation of the vehicle handle assembly showing the handle grip mounted in the mounting base.

Centering member 14 is also preferably molded from resinous plastic and, more preferably from, acetal. Acetal (Celcon M90) is available from Celanese Products, Chattham, N.J. As shown in FIGS. 3, 16–18, centering member 14 is an annular, cup-shaped member having a base 36 and a cylindrical wall 37 extending around the base 36 to define a spring cavity 38 therein (FIGS. 3, 5 and 7). To mount the centering member on the shaft, base 36 includes shaft opening 39 to receive shaft 18 of handle grip 12. Preferably, shaft opening 39 substantially matches the cross-sectional shape of shaft 18 so that rotation of the shaft imparts rotation to centering member 14 when the handle grip 12 is rotated about longitudinal axis 19. Furthermore, since shaft opening 39 in the centering member substantially matches the cross-sectional shape of the shaft, centering member 14 is mounted on shaft 18 in only one of two orientations—the correct orientation in which spring cavity 38 faces outwardly toward the distal end of the shaft or an incorrect position in which the spring cavity faces the mounting base. As the number ways to mount the centering member is reduced to two, the odds of an improper assembly are significantly reduced.

In order to allow centering member 14 to urge handle grip 12 into the correct position, camming surfaces 40 are provided on cylindrical wall 37 of centering member 14 and, preferably, are formed as triangularly shaped teeth 41 which project from opposed sides of the cylindrical wall 37. Teeth 41 have sloping sides 41*a* and 41*b* that preferably form an angle with respect to each other in the range of 20° to 70°. As shown in FIGS. 3 and 14–16, the sloping sides of teeth 41 also form an angle with respect to the shaft axis, preferably an angle in the range of 10° to 35°. Centering collar 25 of mounting base 13 is also provided with matching camming surfaces 42 (FIGS. 4, 14 and 15) which cooperate with camming surfaces 40 to align the centering member 14 and, in turn the handle grip 12 with mounting base 13, as will more fully explained. Camming surfaces 42 are provided by notch recesses formed in the cylindrical side wall 25*a* of collar 25.

Figure 8:
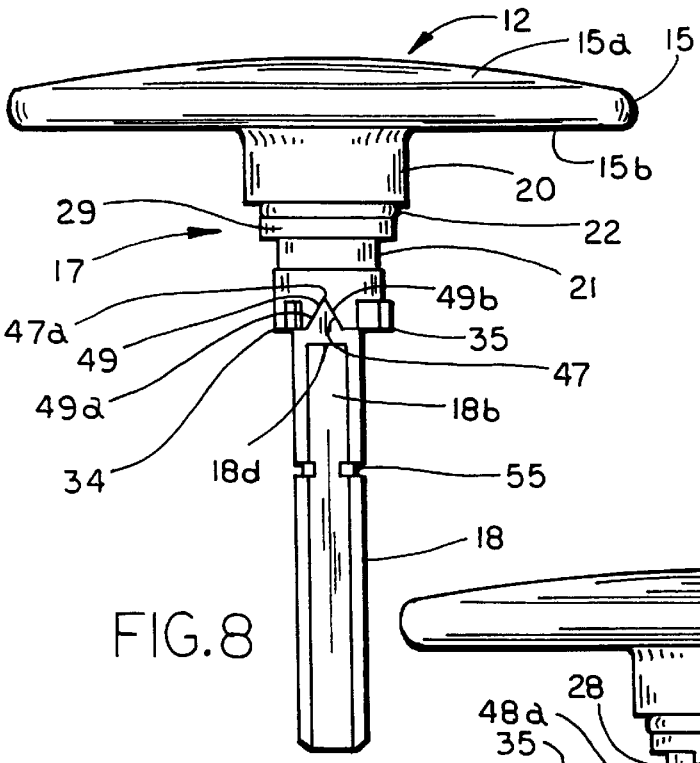
FIG. 8 is a top plan view of the handle grip.
Figure 9:
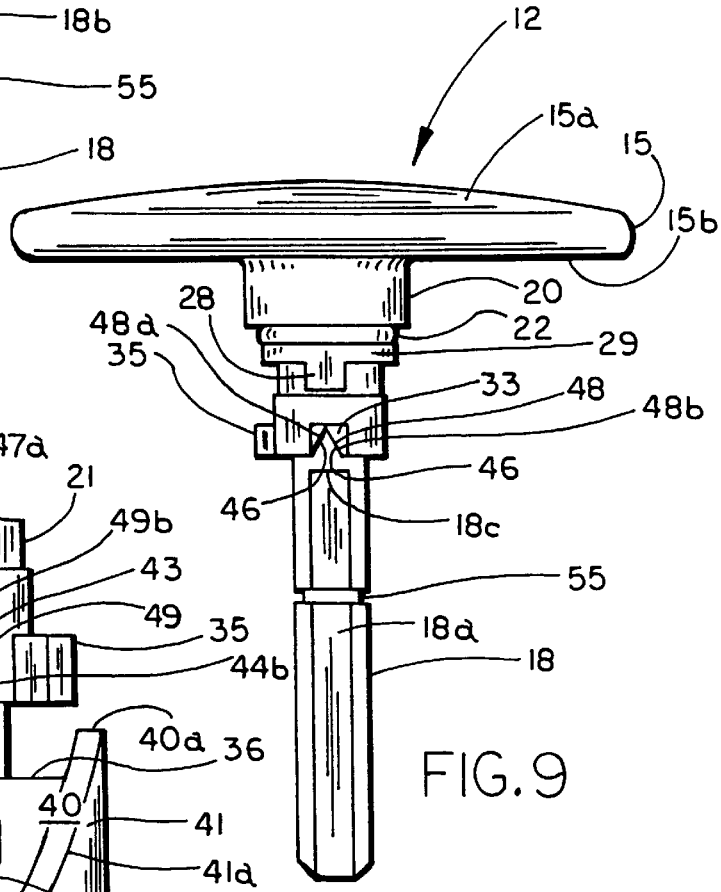
FIG. 9 is a bottom plan view of the handle grip.
Figure 11:
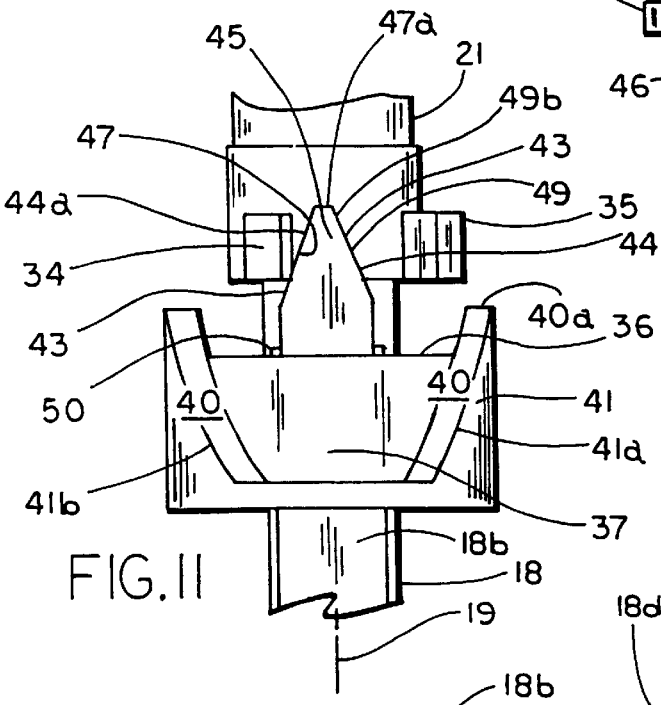
FIG. 11 is an enlarged partial plan view of the handle grip with the centering member positioned to abut the lower portion of the handle grip positioning collar.
Figure 10:
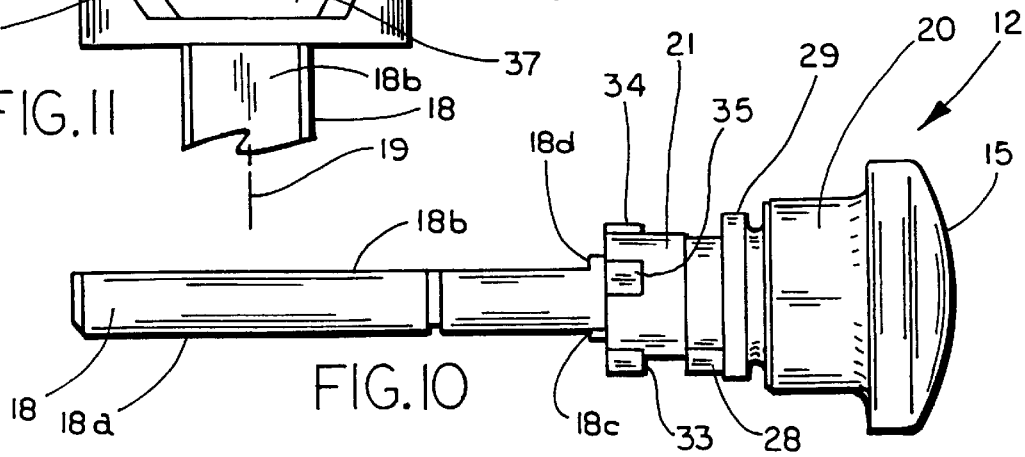
FIG. 10 is a side elevational view of the handle grip showing the positioning lugs.
Figure 12:
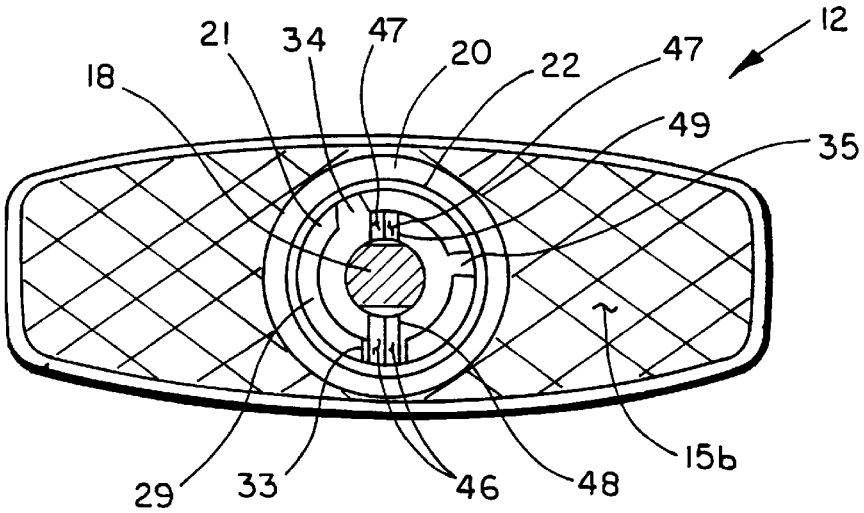
FIG. 12 is a rear elevation view of the handle grip.

Preferably, centering member 14 further includes a second set of camming surfaces 43 which cooperate with the positioning collar 21 of handle grip 12 to slidably engage handle grip 12. Camming surfaces 43 are similarly formed on teeth 44 having triangular shaped distal ends 45 which project from base 36 of centering member's 14 cup-shaped body to engage camming surfaces 46 and 47 provided on handle grip 12 (FIGS. 3, 11, 16–19). Teeth 44 are positioned on base 36 about shaft opening 39 on opposed sides of opening 39 and are oriented at 90° to teeth 41. Preferably, teeth 44 are closer to shaft opening 39 than teeth 41 and have sloping sides 44*a* and 44*b* that preferably form an angle with respect to each other in the range of between about 30° to 35°. As can be seen in FIG. 11, sloping sides 44*a* and 44*b* are angled with respect to the shaft axis 19 and, preferably, form an angle in the range of 15° to 55° with respect to the shaft axis 19. Camming surfaces 46 on handle grip 12 are formed on positioning collar 21 by a notch recess 48 that extends through cylindrical wall 37 and lug 33 (FIG. 12). Camming surfaces 47 are provided by a notch recess 49 that extends through cylindrical wall 37 (FIG. 8). Preferably, notches 48 and 49 are positioned on diametrically opposed sides of the positioning collar 21. When teeth 44 are positioned in notches 48, 49, handle grip 12 is prevented from any "play" or rocking action with respect to mounting base 13 while handle grip 12 is in its neutral, centered position.

As best seen in FIGS. 3 and 11–13, a pair of abutment projections 50 and 51 are also provided on centering member 14. Projections 50 and 51 align with shoulders 18*c* and 18*d* on shaft 18 (FIG. 7) so that when centering member 14 is biased against centering collar 25 of mounting base 13 and positioning collar 21 of handle grip 12, projection 50 abuts shoulder 18*d* and projection 51 abuts shoulder 18*c* to provide reinforcement to base 36 and teeth 44. Moreover, projections 50 and 51 further aid the releasable coupling of centering member 14 to shaft 18 and handle grip 12, and reduce the play between handle grip 12 and the mounting base 13.

Figure 4:
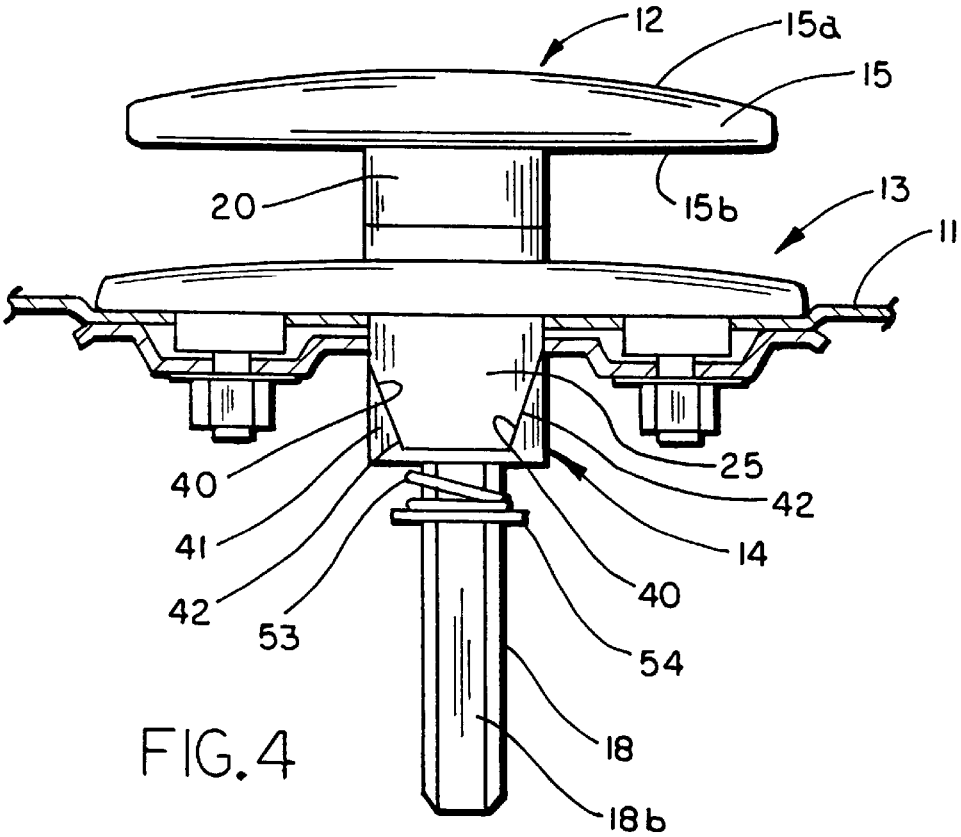
FIG. 4 is a top plan view of the vehicle handle assembly with the handle grip in the mounting base and the centering member fully engaged with the collar of the mounting base.

As best seen in FIGS. 3 and 4, a compression spring 53, preferably formed from spring steel coated with a corrosion resistant plating, such as zinc, is telescoped over shaft 18 and urges centering member 14 against centering collar 25 and positioning collar 21. The stiffness of the spring 53 is dictated by the desired "handle effort", i.e., the stiffer the spring the greater the handle effort. Preferably, spring 53 has a compression force within the range of between about 1.95 N/mm and 3.05 N/mm. By biasing centering member 14 against centering collar 25 and positioning collar 21, centering member 14 urges handle grip 12 to its neutral, centered position in which it is aligned with base 13. The preferred plastic of centering member 14 has a low coefficient of friction. Most preferably, centering member 14 is formed from an acetal material, which has a high oil content, with a very low coefficient of friction and, consequently, exhibits very little wear. In operation, after handle grip 12 is released and when spring 53 is partially compressed but in its most uncompressed position (FIGS. 4–7), spring 53 presses on base 36 of centering member 14 urging camming surfaces 40 and 43 to slide along camming surfaces 42 and 46, respectively, until the distal point of each tooth is positioned in the closed end of each notch. On the other hand, when a rotational torque is applied to handle grip 12 which produces a force sufficient to overcome the compression force of the spring 53 and the friction between the camming surfaces 40, 42, 43 and 46, in either a clockwise or counterclockwise direction, shaft 18 rotates likewise causing centering member 14 to rotate therewith and slide along camming surfaces 42 and 46 away from the centering collar and positioning collar. This camming action causes centering member 14 to move axially along shaft 18 and compress spring 53. When handle grip 12 is released, spring 53 expands pushing centering member 14 down shaft 18. As the centering member 14 slides down the shaft 18, again, camming surfaces 40 and 43 slide along camming surfaces 42 and 46, which imparts rotation to the shaft 18 and, in turn, imparts rotation to handle grip 12. When distal points 40*a* and 43*a* of the teeth 41 and 44 are aligned in the closed ends 42*a* and 46*a* of the notches 42 and 46, handle grip 12 is fully aligned with mounting base 13. Furthermore, projections 50 and 51 abut shoulders 18*d* and 18*c*.

To assure that the camming surfaces 40 and 43 do not completely disengage from each other, stop 28 is positioned such that the camming surfaces 40 and 43 will remain in a cooperative relationship. This cooperative relationship is best maintained if the camming surfaces 40 and 43 overlap, for example, over a minimum region of about ⅛ inch. It should be understood that the size of the over lap depends on the materials used and on the stiffness of the spring—the greater the stiffness of the spring the larger the area of overlap. Similarly, the lower the compressive and shear strength of the centering member material the smaller the required overlap.

Coil spring 53, as can be understood by those having ordinary skill in the art, is easily installed; it is slipped and telescoped over shaft 18 with one end of the spring extending into spring cavity 38 and the other end supported along the shaft's longitudinal axis 19 by a retaining clip 54. Retaining clip 54, preferably formed from spring steel coated with a corrosion protective material, such as zinc, slides into a groove 55 formed in shaft 18. Groove 55 provides retaining clip 54 with a shoulder so that the position of clip 54 along the longitudinal axis 19 of shaft 18 is fixed. Spring 53 is slightly compressed between spring cavity 38 and the abutment surface provided by retaining clip 54 so that centering member 14 is biased into a fully seated position where handle grip 12 and mounting base 13 are centered and aligned.

While the form of the invention has been described in the context of a vehicle door handle, it should be understood that handle assembly 10 can be used in numerous applications, such as furniture, appliances, and architectural components.

Furthermore while one form of the invention has been shown and described, other forms will now be apparent to those skilled in the art. For instance, the projections may be formed on the mounting base collar and the handle grip positioning collar for extending into notches/recesses formed in the centering member. The embodiment of the invention shown in the drawings is not intended to limit the scope of the invention which is defined by the claims which follow.

The embodiments of the invention in which exclusive property or privilege is claimed are defined as:

1. A vehicle handle assembly comprising:

a mounting base;

a centering member;

a handle having a handle grip and a shaft, said handle grip having a front side and a rear side, said shaft extending from said rear side and extending through and being rotatably mounted in said mounting base;

said mounting base adapted to mount said handle on a vehicle panel, said mounting base having front and rear sides and a shaft receiving passage extending therethrough for receiving said shaft, and said shaft extending through and journaled in said shaft receiving passage for rotational movement therein;

a biasing member disposed on said shaft, said biasing member urging said centering member toward said mounting base and said handle grip; and said centering member slidably disposed on said shaft, said centering member having a first portion engaging said mounting base and a second portion engaging said handle grip, said centering member sliding along said shaft and compressing said biasing member when a rotational torque is applied to said handle grip to rotate said handle between at least one unlatching position and a centered position, and said first and second portions of said centering member aligning said handle grip in said mounting base in said centered position when the rotational torque is removed from said handle grip and said biasing member urges said centering member toward said mounting base and said handle grip.

2. A vehicle handle according to claim 1, wherein said biasing member comprises a spring, said spring urging said centering member against said rear sides of said mounting base and against said handle grip and said centering member aligning said handle grip on said mounting base when said first portion and said second portion of said centering member are fully engaged with said mounting base and said handle grip, respectively.

3. A vehicle handle assembly according to claim 1, wherein said centering member comprises a low frictional, resinous material.

4. A vehicle handle according to claim 3, wherein said low frictional resinous material comprises acetal.

5. A vehicle handle assembly according to claim 2, whereby said spring is disposed on said shaft between said centering member and an abutment provided on said shaft.

6. A vehicle handle assembly according to claim 5, whereby said spring comprises a coil spring telescoped on said shaft, said spring being compressible axially along said shaft.

7. A vehicle handle assembly according to claim 6, said spring having a compression force, and the rotational torque inducing a force greater than said compression force of said spring, whereby said first portion and said second portion of said centering member align said handle grip with respect to said mounting base in said centered position until such time that said rotational torque is applied to said handle grip which then causes said first portion and said second portion of said centering member to rotate and slide said centering member away from said rear side of said base such that said handle grip rotates with said shaft between said centered position and said at least one unlatching position.

8. A vehicle handle assembly according to claim 2, wherein said first portion of said centering member includes at least one camming surface for slidably engaging said rear side of said mounting base.

9. A vehicle handle assembly according to claim 8, wherein said rear side of said mounting base includes a collar having at least one camming surface for slidably engaging said at least one camming surface of said centering member.

10. A vehicle handle assembly according to claim 9, wherein one of said camming surfaces on said collar and said centering member comprises a surface of a notch and the other of said camming surfaces comprises a surface on a projection.

11. A vehicle handle assembly according to claim 9, wherein said camming surface of said centering member includes surfaces of a triangularly-shaped tooth and said camming surface of said collar includes surfaces of a triangularly-shaped notch.

12. A vehicle handle assembly according to claim 9, wherein said shaft has an axis of rotation, each of said camming surfaces including sloping sides, said sloping sides being angled with respect to the axis of rotation of said shaft.

13. A vehicle handle assembly according to claim 12, wherein said sloping sides form an angle with respect to each other in the range of 20° to 70°.

14. A vehicle handle assembly according to claim 9, wherein said collar includes at least one recess providing said camming surface on said collar for slidably engaging said centering member.

15. A vehicle handle assembly according to claim 9, wherein said centering member includes a generally annular body having a base and a cylindrical wall extending from said base, said base including a shaft opening for receiving said shaft, and said at least one camming surface is formed on said cylindrical wall for slidably engaging said collar.

16. A vehicle handle assembly according to claim 15, wherein said first portion of said centering member includes a plurality of camming surfaces which are surfaces on a triangularly-shaped tooth.

17. A vehicle handle assembly according to claim 16, wherein said collar includes a plurality of camming surfaces which are surfaces of a substantially triangularly-shaped notch, said camming surfaces on said notch corresponding to and receiving said camming surfaces of said centering member.

18. A vehicle handle assembly comprising:

a mounting base;

a centering member having a plurality of camming surfaces which are surfaces on a triangularly-shaped tooth and including a generally annular body having a base and a cylindrical wall extending from said base, said base including a shaft opening, and said cylindrical wall having at least one of said camming surfaces formed thereon;

a handle grip having a front surface and a rear surface, said handle grip including a shaft on said rear surface and a positioning collar depending from said rear surface of said handle grip and extending around said shaft, said shaft extending through and engaging said mounting base, and said positioning collar adapted to slidably engage said annular body of said centering member;

said mounting base adapted to mount said handle grip on a vehicle panel, said mounting base having front and rear sides and a shaft receiving passage extending therethrough for receiving said shaft, said rear side of said mounting base including a collar having a plurality of camming surfaces which are surfaces on a triangularly-shaped notch, said camming surfaces of said notch corresponding to and receiving said camming surfaces of said centering member for slidably engaging said centering member, and said shaft extending through and journaled in said shaft receiving passage for rotational movement therein;

said centering member slidably disposed on said shaft for longitudinal movement along said shaft and rotation with said shaft, said centering member being positioned on a portion of said shaft which extends through said shaft receiving passage, and said camming surfaces of said centering member slidably engaging said collar of said mounting base such that when a rotational torque is applied to said handle grip, said centering member slides along said shaft away from said rear side of said mounting base to permit said handle grip to rotate between at least one unlatching position and a centered position, said centering member aligning said handle grip with said mounting base in said centered position when the rotational torque is removed from said handle grip; and a spring urging said centering member against said rear side of said mounting base for slidably engaging said rear side of said mounting base.

19. A vehicle handle assembly according to claim 18, wherein said camming surfaces of said centering member comprise a set of first camming surfaces and said annular body includes at least one second camming surface for slidably engaging said positioning collar on said handle grip.

20. A vehicle handle assembly according to claim 19, wherein said positioning collar of said handle grip includes a notch for receiving said second camming surface for slidably engaging said annular body.

21. A vehicle handle assembly according to claim 20, wherein said set of first camming surfaces on said annular body are radially spaced a first distance from said shaft opening, and said second camming surface being radially spaced a second distance from said shaft opening.

22. A vehicle handle assembly according to claim 21, wherein said first distance is greater than said second distance.

23. A vehicle handle assembly according to claim 19, wherein said annular body includes a pair of first projections providing said set of first camming surfaces for engaging said camming surfaces on said collar of said mounting base and includes a second pair of projections providing said at least one second camming surface for engaging said positioning collar of said handle grip.

24. A vehicle handle assembly according to claim 23, wherein said collar of said mounting base includes a pair of notches for receiving said pair of first projections.

25. A vehicle handle assembly according to claim 23, wherein said pair of first projections are positioned on opposed sides of said cylindrical wall from each other.

26. A vehicle handle assembly according to claim 6, wherein said handle grip further includes a stop for limiting rotational movement of said handle grip between a first unlatching position and a second unlatching position.

27. A vehicle handle assembly comprising:

a handle grip having first and second spaced surfaces, a stop, and a shaft which extends from said second surface for extending through a panel on a vehicle, said stop limiting rotational movement of said handle grip between an unlatching position and a neutral position;

a centering member slidably disposed on said shaft for longitudinal movement along said shaft, said centering member positioned on a portion of said shaft for extending through the panel, said centering member adapted to slidably engage the panel and said handle grip to align said handle grip to a desired orientation; and a spring having a predetermined compression force, said spring urging said centering member against said handle grip and for urging said centering member against the panel to slidably couple said centering member to said handle grip and for slidably coupling said centering member to the panel whereby said centering member centers the rotational position of said handle grip to said desired orientation until such time that a torque inducing a force having a magnitude greater than said compression force of said spring is applied to said handle grip which then causes said centering member to slide away from said handle grip and the panel along said shaft until said stop limits rotation of said handle grip to an unlatching position.

28. A vehicle handle assembly according to claim 27, wherein said centering member includes at least one camming surface for slidably coupling said centering member to the panel and at least one second camming surface to slidably couple said centering member to said handle grip.

29. A vehicle handle assembly according to claim 28, wherein said handle grip includes a camming surface for engaging said at least one second camming surface of said centering member to slidably couple said centering member to said handle grip.

30. A vehicle handle assembly according to claim 27, wherein said handle grip includes a plurality of camming surfaces, said camming surfaces comprising sloping sides of a notch provided on said handle grip, and said centering member including a plurality of camming surfaces to slidably couple said centering member to said handle grip.

31. A vehicle handle assembly according to claim 30, wherein said sloping sides form an angle in the range of between about 20° to 70° with respect to each other.

32. A vehicle handle assembly according to claim 28, wherein at least one of said camming surfaces comprises a surface on a projection depending from said centering member.

33. A vehicle handle assembly according to claim 32, wherein said shaft includes an axis of rotation, said projection includes at least one sloping side, said sloping side angled with respect to said shaft axis of rotation.

34. A vehicle handle assembly according to claim 33, wherein said projection includes sloping sides forming an angle in the range of between about 20° to 70° with respect to each other.

35. A vehicle handle assembly according to claim 33, wherein said projection includes at least two sloping sides providing two camming surfaces.

36. A vehicle handle assembly according to claim 27, wherein said centering member comprises a generally cup-shaped body having a base and a cylindrical wall extending from said base, said centering member including a shaft opening in said base for receiving said shaft, a first projection formed on said cylindrical wall to slidably engage said handle grip, and a second projection formed on said cylindrical wall for slidably engaging the panel.

37. A vehicle handle assembly according to claim 36, said first projection being radially spaced a first distance from shaft opening, and said second projection being radially spaced a second distance from said shaft opening.

38. A vehicle handle assembly according to claim 37, wherein said first distance is less than said second distance.

39. A vehicle handle assembly according to claim 37, wherein said first and second projections comprise triangularly-shaped teeth.

40. A vehicle handle assembly according to claim 27, wherein said handle grip includes a positioning collar adapted to engage said centering member.

41. A vehicle handle assembly according to claim 27, wherein one of said handle grip and said centering member includes a projection and the other of said handle grip and said centering member includes a notch, said notch for receiving said projection for slidably coupling said centering member and said handle grip together.

42. A vehicle handle assembly according to claim 27, wherein said centering member is formed from acetal.

43. A vehicle handle assembly comprising:

a mounting base;

a centering member;

a handle having a handle grip and a shaft, said handle grip including first and second spaced apart sides and a stop, said shaft projecting from said second side and extending through said mounting base;

said mounting base adapted to mount said handle to a support surface, said mounting base having first and second sides, a passage extending therethrough, and a projecting member on said second side, said projecting member being adapted to engage said centering member, said shaft extending through and being rotationally mounted in said passage and in said projecting member, said mounting base also including a pair of stop engaging surfaces which limit rotational movement of said handle in said passage between a first unlatching position and a second unlatching position;

said centering member slidably disposed on said shaft, said centering member being positioned on a portion of said shaft which extends through said projecting member, and said centering member having a first portion engaging said projecting member and a second portion engaging said handle grip; and a biasing member having a compression force and urging said first and second portions of said centering member to fully engage said projecting member and said handle grip, said first and second portions aligning said handle grip on said mounting base in a centered position when said first and second portions of said centering member are fully engaged with said projecting member and said handle grip, respectively, and said centering member sliding along said shaft away from said projecting member and said handle grip and compressing said biasing member when a torque is applied to said handle grip, and said stop engaging surfaces limiting rotation of said handle to one of said first unlatching position and said second unlatching position.

44. A vehicle handle assembly according to claim 43, wherein said first portion of said centering member includes at one least pair of camming surfaces for engaging said projecting member.

45. A vehicle handle assembly comprising:

a mounting base;

a centering member;

a handle grip having first and second spaced apart surfaces and a stop, said handle grip including a depending shaft which projects from said second surface and extends through and engages said mounting base;

said mounting base adapted to mount said handle grip to a support surface, said mounting base having first and second surfaces, a passage extending therethrough, a projecting member on said second surface, said projecting member adapted to engage a centering member, said shaft extending through and being rotationally mounted in said passage and said projecting member, and said mounting base further including a pair of stop engaging surfaces which limit rotational movement of said handle grip between a first unlatching position and a second unlatching position;

said centering member positioned on a portion of said shaft which extends through said projecting member and slidably disposed on said shaft for longitudinal movement along said shaft, and said centering member including a first pair of camming surfaces slidably engaging said projecting member and including a second pair of camming surfaces slidably, said second pair of camming surfaces engaging a portion of said handle grip to align said handle grip on said mounting base in a centered position; and a spring having a compression force urging said centering member against said projecting member to couple said centering member to said projecting member whereby said centering member aligns said handle grip on said mounting base in said centered position when said centering member is fully engaged with said projecting member but slides along said projecting member and said shaft when a torque is applied to said handle grip inducing a force that exceeds the compression force of the spring to permit the handle to rotate with respect to said mounting base, said stop limiting rotation to one of said first unlatching position and said second unlatching position.

46. A vehicle handle assembly according to claim 43, wherein said centering member comprises a cup-shaped member having a base and a depending cylindrical wall, said cylindrical wall including projections defining said first portion for slidably engaging said projecting member.

47. A vehicle handle assembly according to claim 46, wherein said shaft includes an axis of rotation, at least one of said projections including sloping sides angled with respect to said shaft axis of rotation.

48. A vehicle handle assembly comprising:

a mounting base;

a centering member, said centering member including a shaft receiving passage and first and second camming surfaces;

a handle having a handle grip and a shaft, said handle grip having first and second spaced apart sides and a stop, said shaft projecting from said second side and extending through said shaft receiving passage of said centering member;

said mounting base adapted to mount said handle to a support surface, said mounting base having first and second sides, a passage extending therethrough, and a protecting member on said second side, said shaft of said handle extending through and being rotationally mounted in said passage of said mounting base and said projecting member, and said mounting base further including a pair of stop engaging surfaces which limit rotational movement of said handle between a first unlatching position and a second unlatching position;

said centering member positioned on a portion of said shaft which extends through said projecting member, said centering member being slidably disposed on said shaft, and said first camming surface of said centering member slidably engaging said handle grip, and said second camming surface of said centering member slidably engaging said projecting member of said mounting base, and said first and second camming surfaces being adapted to rotate said handle grip in said mounting base when said centering member slides along said shaft toward said mounting base and said handle grip; and a biasing member urging said centering member to slide along said shaft toward said said projecting member and said mounting base and urging said first and second camming surfaces to engage said handle grip and said projecting member, respectively, and to rotate said handle grip to said centered position when said first and second camming surfaces are fully engaged with said projecting and said handle grip member, respectively, said first and second camming surfaces urging said centering member away from said handle grip and said mounting base when a torque of sufficient force to compress said biasing member is applied to said handle, and said stop engaging surfaces limiting rotation of said handle to one of said first unlatching position and said second unlatching position.

49. A vehicle handle assembly according to claim 48, wherein said first projection is radially spaced a first distance from shaft opening, and said second shaft is radially spaced a second distance from said shaft opening.

50. A vehicle handle assembly according to claim 48, wherein said base of said annular body further includes projections for abutting shoulders formed on said shaft.

51. A vehicle handle assembly according to claim 43, wherein said centering member is formed from acetal.

52. A centering device for a handle assembly, the handle assembly including a handle grip and a mounting plate, the handle grip including front and rear surfaces and a shaft extending from the rear surface for mounting in the mounting plate, the mounting plate including a shaft receiving passage, said centering device comprising:

a body including a spring cavity and a shaft opening for receiving the shaft such that said body is slidably mountable on and rotatable with the shaft, said body including at least one first camming surface for slidably engaging the mounting plate and at least one second camming surface for slidably engaging the handle grip; and a spring having a compression force positionable on the shaft and extending into said cavity for urging said body to engage the mounting plate, said first camming surface and said second camming surface for slidably engaging the mounting plate and the handle grip, respectively, to align the handle grip on the mounting plate in a centered position until a torque inducing a force having a magnitude greater than said compression force of said spring is applied to the handle grip.

53. A centering device for a handle assembly, the handle assembly including a handle grip and a mounting plate, the handle grip including front and rear surfaces and a shaft extending from the rear surface for mounting in the mounting plate, the mounting plate including a shaft receiving passage and a collar depending from a rear surface of the mounting plate and extending around the shaft receiving passage, said centering device comprising:

a cup-shaped body having a base and sides depending from said base to define a spring cavity, said base including a shaft opening for receiving the shaft such that said cup-shaped body is slidably mountable on and rotatable with the shaft, said sides of said cup-shaped body including a first pair of camming surfaces for slidably engaging the collar of the mounting plate, and said base of said centering device including a second pair of camming surfaces for slidably engaging the handle grip for aligning the handle grip on the mounting plate in a centered position; and a spring having a compression force positionable on the shaft and extending into said cavity for urging said body to engage the mounting plate and the handle grip to align the handle grip on the mounting plate in the centered position until a torque inducing a force having a magnitude greater than said compression force of said spring is applied to the handle grip.

54. A centering device according to claim 53, said base including a pair of spaced stops, said pair of stops adapted to abut shoulders formed on the shaft for releasably coupling said cup-shaped body to the handle grip.

55. A centering device according to claim 54, wherein said first pair of camming surfaces comprise a pair of triangular-shaped teeth positioned on opposed sides of said cup-shaped body, and said second pair of camming surfaces comprise a pair of projections having triangular-shaped ends, said projections positioned on opposed sides of said cup-shaped body.

56. A centering device according to claim 55, wherein said triangular shaped teeth are radially spaced a first distance from said shaft opening, and said pair of projections are radially spaced a second distance from said shaft opening, wherein said first distance is greater than said second distance.

57. A vehicle handle assembly according to claim 1, wherein said second portion of said centering member includes at least one camming surface, said at least one camming surface slidably engaging said handle grip and aligning said handle grip in said centered position on said mounting base when said camming surface is fully engaged with said handle grip.

58. A vehicle handle assembly according claim 1, said rear side of said handle grip further including a positioning collar, and said positioning collar being adapted to slidably engage said centering member.

59. A vehicle handle assembly according claim 58, wherein said positioning collar of said handle grip includes at least one camming surface, said centering member including at least one camming surface for slidably engaging said at least one camming surface of said positioning collar.

60. A vehicle handle assembly according claim 59, wherein said positioning collar includes a plurality of camming surfaces, said centering member including a plurality of centering member camming surfaces.

61. A vehicle handle according to claim 60, wherein said positioning collar camming surfaces comprise surfaces of one of a notch and a projection, said centering member camming surfaces comprising surfaces of the other of said notch and said projection.

62. A vehicle handle according to claim 61, wherein said projection is formed on said centering member.

63. A vehicle handle according to claim 61, wherein said projection comprises a triangular-shaped tooth.

* * * * *

UNITED STATES PATENT AND TRADEMARK OFFICE

CERTIFICATE OF CORRECTION

PATENT NO. : 5,882,053
DATED : March 16, 1999
INVENTOR(S) : Terrence J. Bekins, et al It is certified that error appears in the above-identified patent and that said Letters Patent is hereby corrected as shown below:

Column 4, line 36:

Please inert --of the-- between "shaft" and "handle".

Column 7, line 39:

Please insert --,-- after "turn".

Column 9, Claim 2, line 63:

Please insert --,-- after "grip".

Column 15, Claim 48, line 15:

Please delete "protecting" and insert in lieu thereof --projecting--.

Signed and Sealed this

Fifteenth Day of August, 2000

*Attest:*

Q. TODD DICKINSON

*Attesting Officer*

*Director of Patents and Trademarks*